US008997375B2

(12) United States Patent
Bae et al.

(10) Patent No.: US 8,997,375 B2
(45) Date of Patent: Apr. 7, 2015

(54) OPERATING METHOD FOR LAUNDRY EQUIPMENT INCLUDING A SCENT SUPPLY MODULE

(75) Inventors: Sang-Hun Bae, Seoul (KR); Sung-Ho Song, Seoul (KR); Min-Ji Kim, Seoul (KR); Yong-Cheol Jin, Seoul (KR)

(73) Assignee: LG Electronics Inc., Seoul (KR)

( * ) Notice: Subject to any disclaimer, the term of this patent is extended or adjusted under 35 U.S.C. 154(b) by 771 days.

(21) Appl. No.: 13/148,702

(22) PCT Filed: Apr. 16, 2010

(86) PCT No.: PCT/KR2010/002379

§ 371 (c)(1),
(2), (4) Date: Aug. 10, 2011

(87) PCT Pub. No.: WO2010/120146

PCT Pub. Date: Oct. 21, 2010

(65) Prior Publication Data

US 2011/0308102 A1 Dec. 22, 2011

(30) Foreign Application Priority Data

Apr. 17, 2009 (KR) ..... 10-2009-0033839
Apr. 17, 2009 (KR) ..... 10-2009-0033842
Apr. 17, 2009 (KR) ..... 10-2009-0033847
Apr. 17, 2009 (KR) ..... 10-2009-0033849

(51) Int. Cl.
*F26B 3/00* (2006.01)
*D06F 58/20* (2006.01)

(52) U.S. Cl.
CPC ..... *D06F 58/203* (2013.01)

(58) Field of Classification Search
CPC ..... D06F 58/28
USPC ..... 34/329, 343, 348, 350, 357, 380
See application file for complete search history.

(56) References Cited

U.S. PATENT DOCUMENTS

| | | | | |
|---|---|---|---|---|
| 7,066,412 | B2 * | 6/2006 | Conley et al. | 239/690 |
| 7,735,345 | B2 * | 6/2010 | Wright et al. | 68/13 R |
| 2010/0000112 | A1 * | 1/2010 | Carow et al. | 34/357 |

FOREIGN PATENT DOCUMENTS

| | | | |
|---|---|---|---|
| CN | 101381936 | A | 3/2009 |
| DE | 2823351 | A1 | 12/1979 |
| EP | 0676497 | A2 | 4/1995 |
| EP | 1852539 | A1 | 11/2007 |
| EP | 1852541 | A1 | 11/2007 |
| JP | 07-068094 | A | 3/1995 |
| KR | 10-2006-0060227 | A | 6/2006 |
| KR | 10-0593633 | B1 | 6/2006 |
| KR | 1020060060227 | A | 6/2006 |
| KR | 10-2009-0008417 | A | 1/2009 |
| KR | 10-2010-0018385 | A | 2/2010 |

* cited by examiner

*Primary Examiner* — Kenneth Rinehart
*Assistant Examiner* — Gajanan M Prabhu
(74) *Attorney, Agent, or Firm* — McKenna Long & Aldridge LLP

(57) ABSTRACT

An operating method for a laundry drier which has a rotatable drum mounted inside a main body, a heater for heating the air flowing into the drum; and a scent supply module for spraying scent into the drum, comprising: a drying step of drying the laundry by supplying hot air heated by the heater; a pre-treating step of tumbling the drum while supplying air with the heater off; and a scent treating step of spraying scent onto the laundry which has passed through the pre-treating step. Since the scent is sprayed on after the pre-treating step, the scent can be effectively deposited on the laundry.

18 Claims, 13 Drawing Sheets

OPERATING METHOD FOR LAUNDRY EQUIPMENT INCLUDING A SCENT SUPPLY MODULE

This application is a 35 U.S.C. §371 National Stage entry of International Application No. PCT/KR2010/002379, filed on Apr. 16, 2010, which claims the benefit of the earlier filing date and right of priority to Korean Application No. 10-2009-0033839, filed Apr. 17, 2009, Korean Application No. 10-2009-0033842, filed Apr. 17, 2009, Korean Application No. 10-2009-0033847, filed Apr. 17, 2009, and Korean Application No. 10-2009-0033849, filed Apr. 17, 2009, the contents of which are hereby incorporated by reference herein in their entirety.

TECHNICAL FIELD

The present disclosure relates to a controlling method for a laundry equipment having a module for spraying scent into a drum, and more particularly, a scent spraying control method for effectively depositing scent sprayed into a drum onto a laundry in a laundry equipment having a scent supply module.

BACKGROUND ART

In general, laundry equipment (laundry (clothes) treating apparatus) includes a washing machine, a clothes dryer or a washing-drying machine simultaneously having washing and drying functions. The washing machine is an apparatus for removing contaminants from a contaminated laundry through washing, rinsing and dehydrating (spin-drying) processes. The washing machine includes a main body defining an appearance, a tub installed within the main body for storing water, and a drum rotatably mounted inside the tub. A laundry and washing water are filled in the drum together with a detergent and rotated to apply physical impacts to the laundry, thereby washing the laundry. Typically, washing machines are categorized into two types according to whether a rotational shaft of the drum is horizontal or vertical, namely, into a top-load type washing machine having the vertical rotational shaft, and a drum type washing machine having the horizontal rotational shaft.

The laundry dryer refers to an apparatus, in which a completely dehydrated laundry after being washed is thrown into a drum of the dryer and hot air is supplied into the drum to dry the laundry by evaporating moisture contained in the laundry. The dryer includes a drum located within the dryer in which the laundry is accommodated, a driving motor for rotating the drum, a blow fan for blowing air into the drum, and a heating unit (heater) for heating air introduced into the drum. The heating unit may use high temperature electrical resistance heat generated by using electrical resistance, or heat of combustion generated upon combusting gas.

The air discharged out of the drum of the dryer contains moisture of the laundry filled in the drum so as to be hot and humid. Here, the dryers are classified, according to how to process the hot humid air, into a condensing type dryer, in which hot humid air circulates without being discharged out of the dryer to be heat-exchanged with external air within a condenser such that moisture contained within the hot humid air can be condensed, and an exhaust type dryer, in which hot humid air passed through the drum is discharged directly to the outside of the dryer.

However, in regard of the washing machines or dryers, various attempts to deposit specific scent desired by a user onto a laundry after completed drying have been done. When such specific scent is supplied onto the completely dried laundry, it may be helpful to remove laundry-specific odor and also to enhance user's satisfaction about the product.

To this end, in the related art, scent material-cohered non-woven fabric was put into the drum together with the laundry to remove an odor of a remnant detergent within the laundry and an odor of water used for washing and to supply new scent. However, the related art method had several problems. Namely, the non-woven fabric component used was not completely decomposed and accordingly sometimes caused a mechanical disorder, such as blocking a filter while moving together with the laundry within the drum of the dryer, and lowered a scent supply function due to a local contact with the laundry to be dried. Furthermore, recycling of the non-woven fabric after used was difficult, which caused an environmental problem such as creating waste or the like. Since the non-woven fabric was thrown into the dryer at an initial step of a drying stroke, scent was not sufficiently left on the laundry after completion of the drying stroke.

The related art also employed a scent supply method, in which a solid type scent material stored within the dryer was heated or affected by vibration, if necessary, to emit scent, and the emitted scent was supplied into the drum of the dryer via a scent supply duct. However, the solid type scent supply unit was difficult to supply scent enough into the drum and also incapable of spraying scent into the drum in time when required.

The related art also employed a method for supplying scent by spraying a liquid type scent material into the drum. However, such scent was not effectively deposited onto the laundry within the drum, which required excessive scent to be sprayed, thereby causing consumption of the scent solution stored in the dryer. Or, an appropriate method for controlling a scent spraying module was not present, thereby affecting a lifespan of an apparatus for supplying scent.

DISCLOSURE OF THE INVENTION

Therefore, to obviate those problems, an aspect of the detailed description is to provide a method for spraying scent into a drum of a dryer by employing a scent supply module, which is capable of spraying scent effectively into the drum, thereby maintaining reliability and durability of the scent supply module and effectively depositing scent onto a laundry within the drum.

To achieve these and other advantages and in accordance with the purpose of the present disclosure, as embodied and broadly described herein, there is provided a method for operating a laundry dryer including a drum rotatably mounted inside a main body, a heater for heating air flowing into the drum, and a scent supply module for spraying scent into the drum, the method including a drying step of drying the laundry by supplying hot air heated by the heater, a pre-treating step of tumbling the drum while supplying air with the heater off, and a scent treating step of spraying scent onto the laundry passed through the pre-treating step.

With the configuration, as the scent is sprayed onto the laundry which has passed through the pre-treating step, the scent can be effectively deposited onto the laundry.

The drying step may include a remnant scent removing step of removing scent remaining in the scent supply module by temporarily spraying scent into the drum from the scent supply module.

A time taken for the pre-treating step may be longer than a time taken for the scent treating step, and a temperature inside the drum may be cooled down to 30° C. at the pre-treating step. Preferably, the pre-treating step may be carried out for 4 to 5 minutes.

Spraying scent at the scent treating step may be carried out by one of an intermittent spraying and a consecutive spraying based upon a laundry amount, and the drum may be continuously tumbled during the scent treating step.

The scent may preferably be sprayed at the scent treating step when the temperature of the drum is in the range of 20° C. to 40° C., and air may not be supplied into the drum during the scent treating step.

At the scent treating step, the intermittent spraying may be carried out when the laundry amount inserted within the drum is larger than a reference value, and the consecutive spraying may be carried out when the laundry amount inserted within the drum is smaller than the reference value. The reference value of the laundry amount may be 3 kg, and the number of spraying scent at the intermittent spraying may be 3 times or 4 times.

In accordance with another aspect of this specification, a method for operating a laundry dryer, performing a pre-treating step of drying the laundry by supplying air heated by a heater into a drum and then cooling the drum by supplying air with the heater off, may include a scent treating step of spraying scent onto the laundry which has passed through the pre-treating step, and a post-treating step of supplying air with the heater off.

With the configuration, the scent can be effectively deposited onto the laundry by spraying the scent onto the laundry inserted within the laundry dryer, and carrying out the post-treating step.

The drum may be continuously tumbled during the pre-treating step, the scent treating step and the post-treating step, and air may not be supplied into the drum during the scent treating step.

The scent may preferably be sprayed at the scent treating step when the temperature of the drum is in the range of 20° C. to 40° C.

At the scent treating step, the intermittent spraying may be carried out when the laundry amount inserted within the drum is larger than a reference value, and the consecutive spraying may be carried out when the laundry amount inserted within the drum is smaller than the reference value.

The post-treating step may include a first post-treating step of supplying air into the drum with the heater off, a post-treating drying step of supplying air into the drum with the heater on, and a second post-treating step of supplying air into the drum with the heater off, wherein the post-treating drying step may be carried out to dry moisture generated due to the scent sprayed onto the laundry during the scent treating step.

A time taken for the first post-treating step may be longer than a time taken for the second post-treating step, and preferably, the first post-treating step, the post-treating drying step and the second post-treating step may be carried out for 4 minutes, 0.5 minutes and 1 minute, respectively.

In accordance with another aspect of this specification, a method for operating a laundry dryer, which includes a pre-treating step of drying the laundry by supplying air heated by a heater into a drum and then cooling the drum by supplying air with the heater off, and a scent treating step of spraying scent into the drum, may include a scent intensity selecting step of selecting intensity of the scent sprayed into the drum prior to the scent treating step.

With the configuration, as the process of selecting the scent intensity is performed prior to spraying the scent onto the laundry, the scent can be sprayed onto the laundry with various intensities according to user's requirements.

When the scent intensity is selected at the scent intensity selecting step, the intensity of the scent sprayed at the scent treating step may be adjusted based upon the temperature inside the drum. As the scent intensity selected at the scent intensity selecting step is stronger, the internal temperature of the drum when the scent is sprayed at the scent treating step may become lower.

The scent may preferably be sprayed at the scent treating step when the temperature of the drum is in the range of 20° C. to 40° C.

When the scent intensity is selected at the scent intensity selecting step, the intensity of scent sprayed at the scent treating step may be adjusted based upon a cooling time of the pre-treating step. As the scent intensity selected at the scent intensity selecting step is stronger, the cooling time of the pre-treating step may become longer.

When the scent intensity is selected at the scent intensity selecting step, the intensity of scent sprayed at the scent treating step may be adjusted based upon a time for which the scent is sprayed. As the scent intensity selected at the scent intensity selecting step is stronger, the time for which the scent is sprayed at the scent treating step may become longer.

In accordance with another aspect of this specification, a scent refreshing method for a laundry dryer including a drum rotatably mounted inside a main body, a heater for heating air flowing into the drum, and a scent supply module for spraying scent into the drum, may include a selecting step of selecting a scent refresh course, a hot air supplying step of supplying hot air heated by the heater into the drum, a first scent spraying step of spraying scent into the drum, a pre-treating step of supplying air into the drum with the heater off to cool the drum, a second scent spraying step of spraying scent into the drum, and a post-treating step of supplying air for cooling with the heater off.

The first scent spraying step may be carried out while the hot air supplying step is ongoing. A time taken for the first scent spraying step may be set longer than a time taken for the second scent spraying step so as to remove wrinkles and odor from the laundry.

The post-treating step may include a first post-treating step of supplying air into the drum with the heater off, a post-treating drying step of supplying air into the drum with the heater on, and a second post-treating step of supplying air into the drum with the heater off.

The drum may be continuously tumbled during the hot air supplying step to the post-treating step.

Air may not be supplied into the drum during the first scent spraying step and the second scent spraying step.

The selecting step of selecting the scent refresh course may include a scent intensity selecting step of selecting intensity of the scent sprayed into the drum. When the scent intensity is selected at the scent intensity selecting step, the intensity of the scent sprayed at the first scent spraying step may be adjusted based upon an internal temperature of the drum.

Alternatively, when the scent intensity is selected at the scent intensity selecting step, the intensity of the scent sprayed at the first scent spraying step may be adjusted based upon a time for which the scent is sprayed into the drum.

Advantageous Effect

In accordance with the configuration of the detailed description, reliability, durability and the like of the scent supply module can be maintained and scent can be sprayed to be effectively deposited onto the laundry within the drum of the dryer.

MODES FOR CARRYING OUT THE PREFERRED EMBODIMENTS

Embodiments of the present invention will be described below in detail with reference to the accompanying drawings where those components are rendered the same reference number that are the same or are in correspondence, regardless of the figure number, and redundant explanations are omitted. In describing the present invention, if a detailed explanation for a related known function or construction is considered to unnecessarily divert the gist of the present invention, such explanation has been omitted but would be understood by those skilled in the art. The accompanying drawings are used to help easily understood the technical idea of the present invention and it should be understood that the idea of the present invention is not limited by the accompanying drawings. The idea of the present invention should be construed to extend to any alterations, equivalents and substitutes besides the accompanying drawings.

Hereinafter, description will be given in detail of a configuration of a laundry dryer and a scent spraying method using a scent supply module in accordance with the exemplary embodiments with reference to the accompanying drawings.

Figure 1:
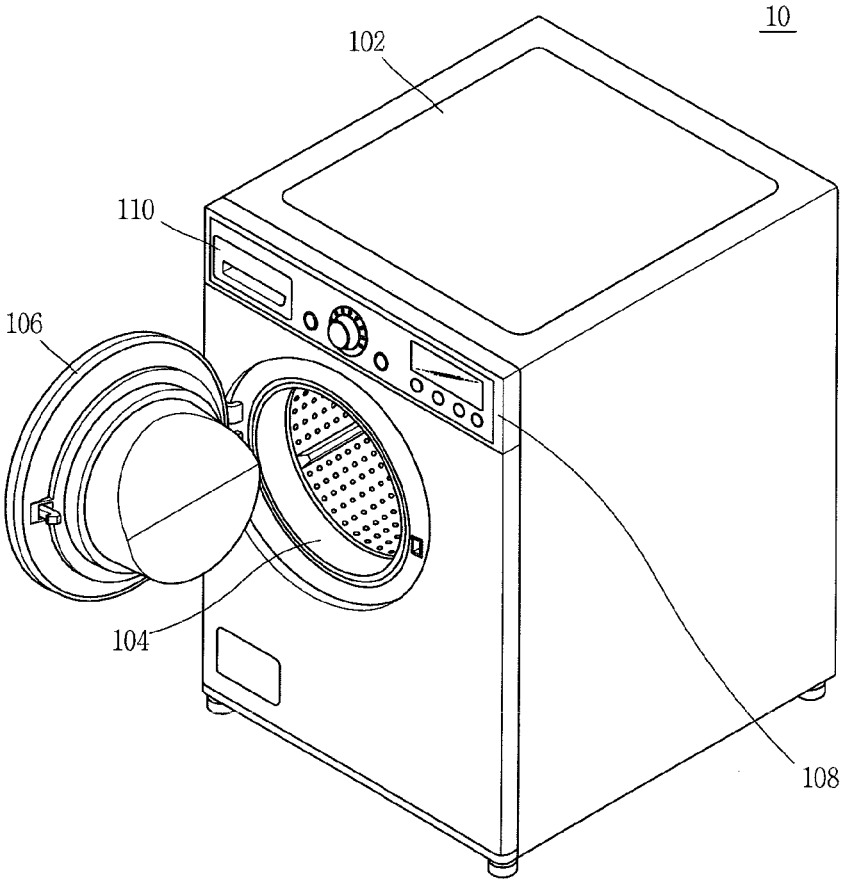
FIG. 1 is a perspective view showing an appearance of a laundry dryer in accordance with this specification.
Figure 2:
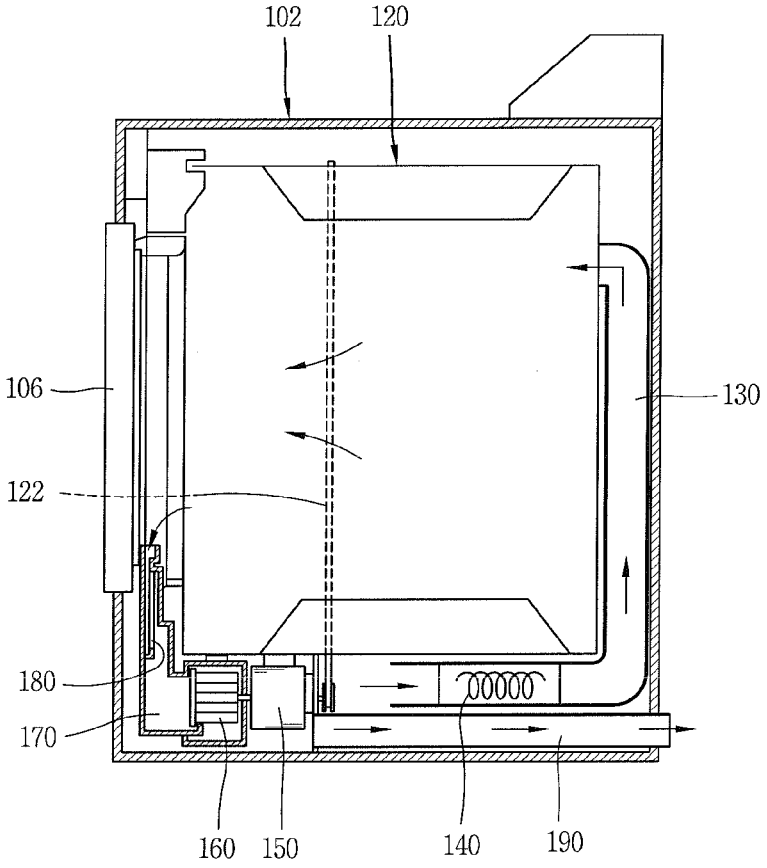
FIG. 2 is a longitudinal sectional view showing the inside of the laundry dryer of FIG. 1.

FIG. 1 is a perspective view schematically showing one exemplary embodiment of a laundry equipment in accordance with this specification, and FIG. 2 is a sectional view schematically showing an internal structure of FIG. 1.

As shown in FIGS. 1 and 2, the dryer 100 may include a main body 102 defining an appearance of the apparatus, and an entrance hole 104 formed at the front of the main body 102 for putting a laundry as a target to be dried into the main body 102. The entrance hole 104 may be open or closed by a door 106. A manipulation panel 108 having various manipulation buttons for operating the dryer may be located above the entrance hole 104. Of course, the present disclosure may not be limited to the dryer, but applicable to a certain laundry equipment having a drying function, for example, a washing machine or the like, which has the drying function.

In the meantime, one side of the manipulation panel 108 is shown having a drawer cover 110, in which a cartridge to be explained later may be mounted. The cartridge may contain liquid, in detail, a scent solution to be sprayed into a drum. The scent solution may be a mixture that water and an undiluted solution for emitting scent are mixed at a predetermined rate.

The dryer as the laundry equipment may include a drum 120 rotatably installed inside the main body 102 for allowing the target to be dried to be dried therein. The drum 120 may be rotatably supported by front and rear supporters. The drum 120 may be connected to a driving motor 150 located in a lower portion of the dryer via a power transfer belt 122 to receive a rotational force from the driving motor 150. A suction duct 130 may be installed at the rear of the drum 120. A heater 140 for heating introduced air may be installed at an inlet side of the suction duct 130. A lower side at the front of the drum 120 is shown having a filter 180 for filtering off foreign materials, such as lint or the like, contained in air discharged out of the drum 120, and ducts 170 and 190 for completely discharging the air, from which the foreign materials are filtered off, to the outside of the dryer.

A blow fan 160 for sucking air within the drum 120 to forcibly blow to the outside of the dryer may be installed at the duct 170. The duct 190 may have one end portion communicating with the outside of the main body 102 to induce the air forcibly blown by the blow fan 160 to the outside of the dryer. In this exemplary embodiment, the blow fan 160 may be a pull type blow fan which is present on a duct, into which air is exhausted from the drum, so as to suck the air discharged out of the drum toward an exhaust duct. Alternatively, according to the configuration of the dryer, a blow fan may be located within the suction duct 130 to push heated air within the suction duct 130 into the drum 120. This blow fan is referred to as a push type.

The power transfer belt 122 for driving (rotating) the drum 120 may be connected to a pulley formed at one side of the driving motor 150, and a driving shaft of the blow fan 160 for driving (rotating) the blow fan 160 may be connected to the other side of the driving motor 150. Hence, this exemplary embodiment may be implemented such that the drum and the blow fan can rotate at the same time in response to rotation of the driving motor 150. As such, a system for simultaneously driving the drum and the blow fan by using a single motor is called a one-motor system.

Figure 3:
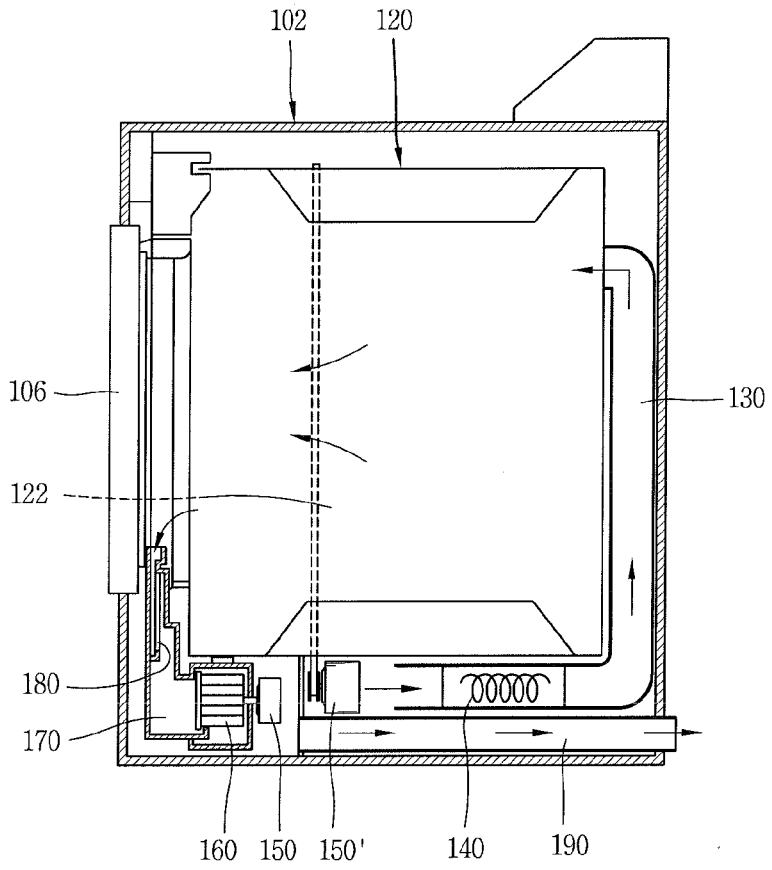
FIG. 3 is a longitudinal sectional view showing the inside of the laundry dryer of FIG. 2 in accordance with another exemplary embodiment.

However, a drum driving motor for rotating the drum 120 and a fan motor for rotating the blow fan 160 may be separated be provided, accordingly, two motors are disposed, which is called a two-motor system as shown in FIG. 3. The sectional view of FIG. 3 is approximately the same as FIG. 2, excluding that the fan motor 150 for driving the blow fan 160 and a driving motor 150' for driving the drum 120 are separately located in the lower portion of the dryer. This two-motor system can control two motors, respectively, which allows independent rotation of the drum and the blow fan. The advantage of the independent rotation will be described hereinafter when explaining a scent spraying method.

Figure 4:
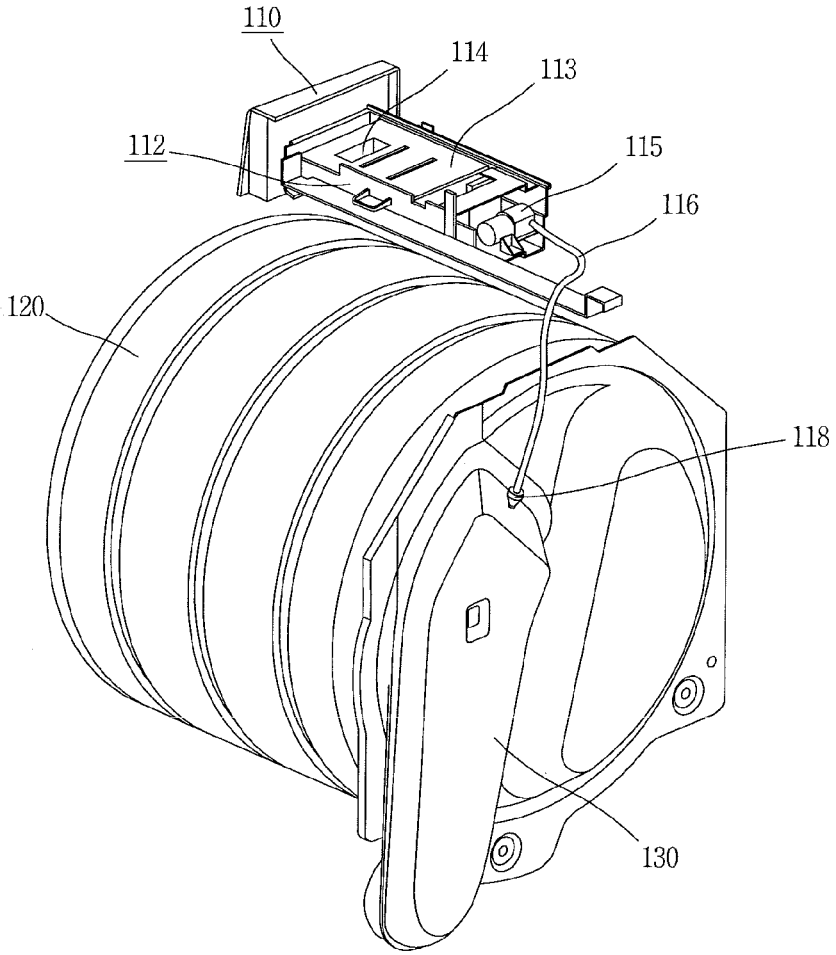
FIG. 4 is a perspective view showing a partial configuration of the inside of a laundry dryer having a scent supply module in accordance with one exemplary embodiment.

FIG. 4 is a perspective view briefly showing a drum and a scent supply module formed in a type that a cartridge is inserted in a drawer, within the dryer. Referring to FIG. 4, a drawer 112 may be mounted onto a rear surface of the drawer cover 110. The drawer 112 may be retracted and drawn out together with the drawer cover 110, and accommodate a cartridge 113 inside thereof. The cartridge 113 may be a hollow container for store a scent solution, which is injected via an injection hole 114 formed through an upper surface of the cartridge 113. Meanwhile, the cartridge 113 may be coupled to a spraying pump 115 via a check valve (not shown) to allow the liquid stored within the cartridge 113 to be sprayed with high pressure by means of the pump 115 and flow along a connection hose 116. The connection hose 116 may be connected to a nozzle 118, which is installed at an upper portion of the suction duct 130 fixed to the rear supporter, which rotatably supports the drum 120. Accordingly, the scent solution stored in the cartridge 113 can be sprayed in a pulverized state into the drum 120 via the suction duct 130. This exemplary embodiment has illustrated, but not limited to, that the nozzle 118 is installed at the suction duct 130. Alternatively, the nozzle 118 may be installed at the rear surface of the drum 120 to allow the scent solution to be sprayed directly into the drum 120.

The foregoing description has been given of the type that the scent supply module for supplying the scent solution is implemented as a drawer type cartridge. In accordance with another exemplary embodiment, a scent supply module may be mounted onto an upper portion of the main body or onto a front supporter, which supports the drum of the dryer at the front side.

Figure 5:
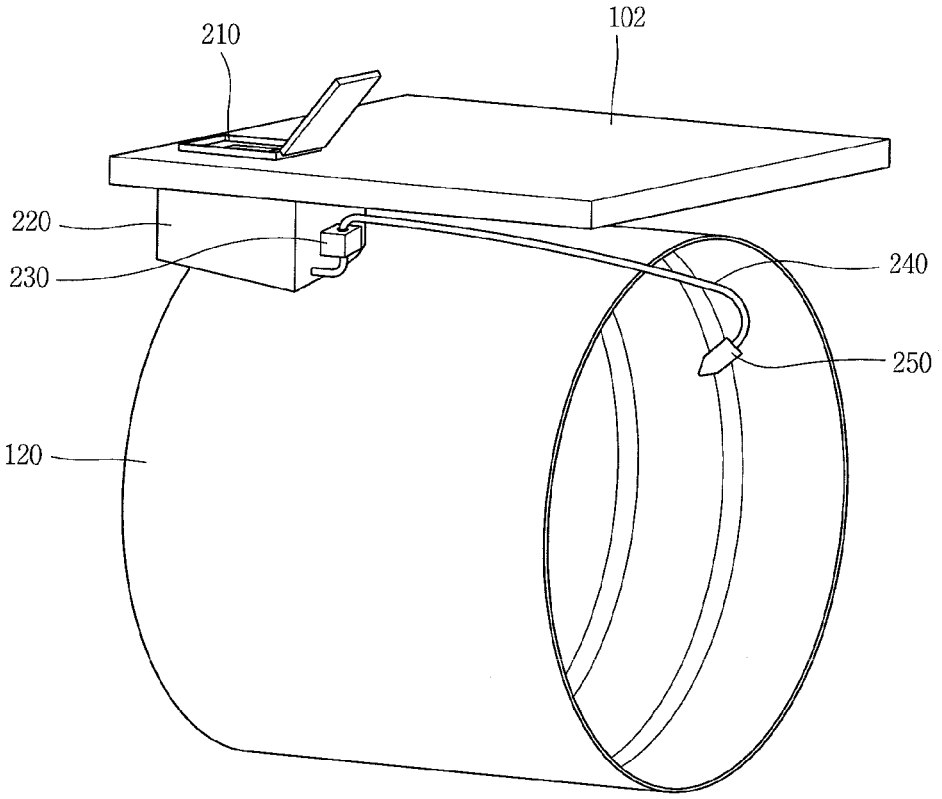
FIG. 5 is a perspective view showing a partial configuration of the inside of a laundry dryer having a scent supply module in accordance with another exemplary embodiment.

FIG. 5 shows that a scent supply module is mounted to an upper side, namely, a top plate of the main body of the dryer in accordance with another exemplary embodiment. Referring to FIG. 5, a scent supply module may include a chamber 220 mounted to a top plate 102 of the main body to supply scent into the drum and storing a scent solution therein, an injection portion 210 for injecting the scent solution into the chamber 220 therethrough, a pump 230 connected to the chamber 220 to pressurize the scent solution, and a nozzle 250 connected to the pump 230 via a tube 240 for spraying scent into the drum 120. The top plate 102 may have a through hole for mounting the scent supply module. The scent supply module may thusly be mounted to the top plate 120 via the through hole. In detail, a cover for opening or closing the injection portion 210 may be provided at the injection portion 210. Accordingly, after opening the cover, the scent solution is injected into the chamber 220 via the injection portion 210. The scent solution stored in the chamber 220 is pressurized by the pump 230 at a required timing by virtue of a dryer controller to be sprayed into the drum 120 via the tube 240 and the nozzle 250.

Figure 6:
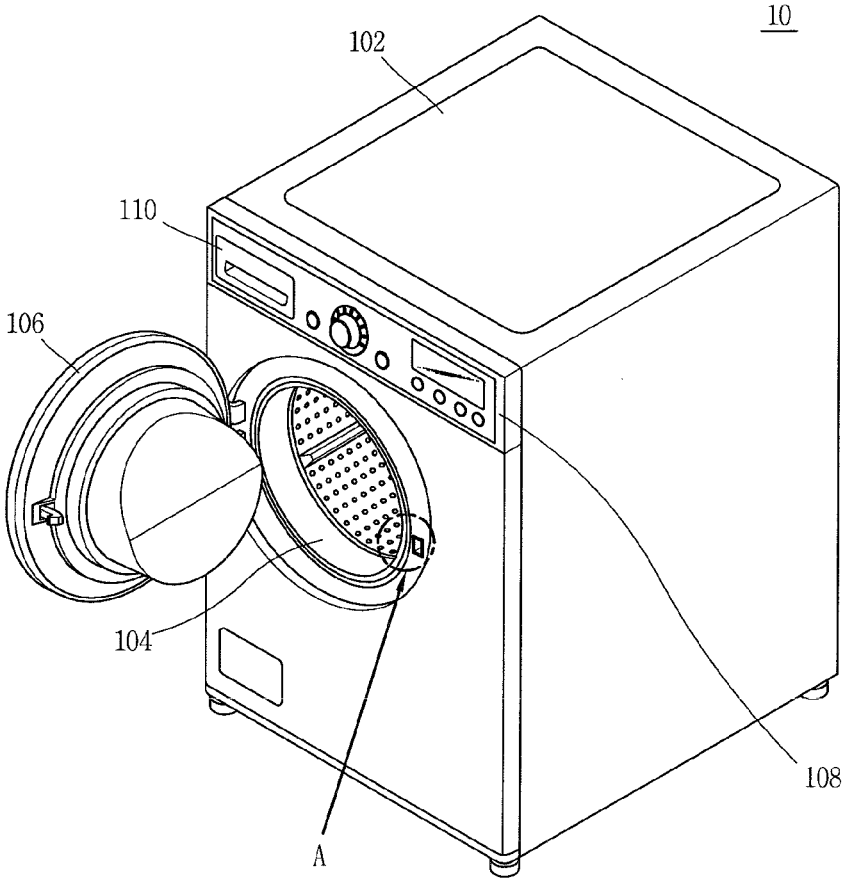
FIG. 6 is a perspective view showing a laundry dryer having a scent supply module in accordance with another exemplary embodiment.
Figure 7:
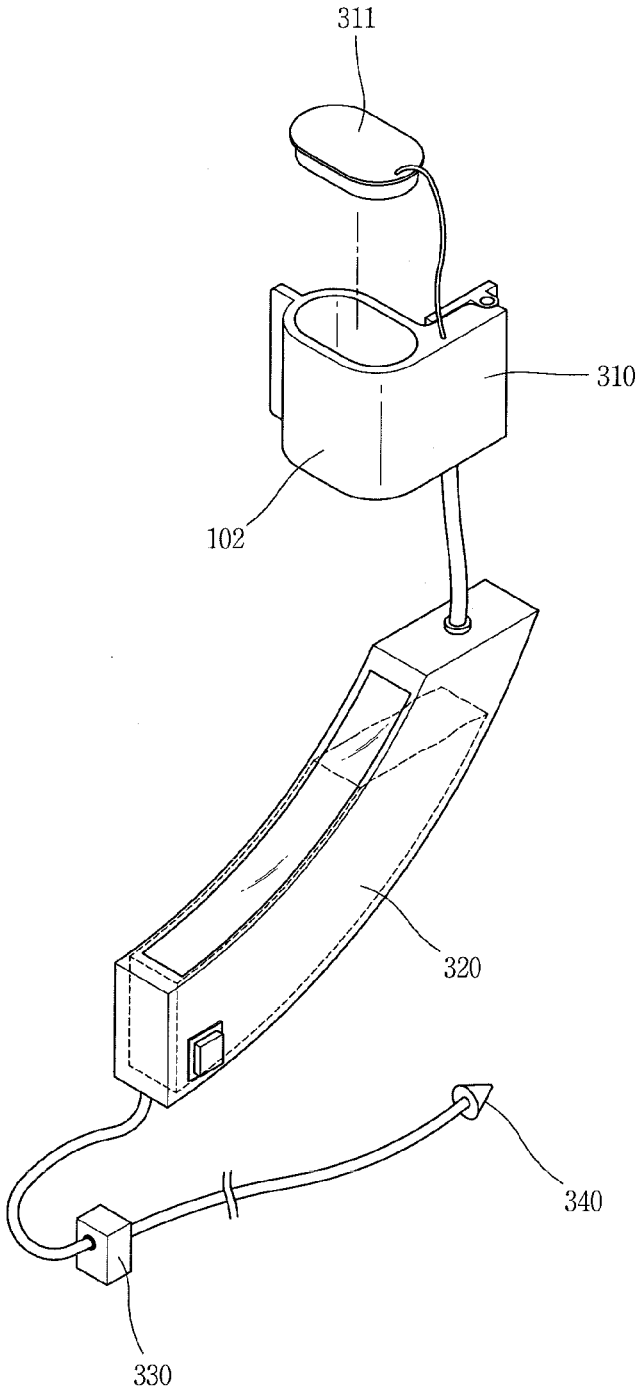
FIG. 7 is a perspective view of the scent supply module mounted to the laundry dryer of FIG. 6.

FIG. 6 shows another exemplary embodiment of a laundry dryer in accordance with this specification, which shows that a scent supply module is mounted inside the front supporter of the dryer (i.e., to a portion A), and FIG. 7 is a perspective view showing an overall scent supply module mounted to the laundry dryer shown in FIG. 6. Referring to FIG. 7, the scent supply module may include an injection hole 310 for injecting a scent solution in a liquid state therethrough, a storage chamber 320 for storing the scent solution therein, a pump 330 for applying predetermined pressure to the scent solution stored in the storage chamber 320, and a nozzle 340 for spraying the scent solution pressurized by the pump 330. The scent supply module may further include a cap 311 for opening or closing the injection hole 310.

Hereinafter, description will be given of a method for supplying scent into a drum of a dryer using the aforesaid scent supply module.

A scent spraying method for spraying scent into a drum of a dryer by controlling the scent supply module may include (1) pre-treating step, (2) scent treating step and (3) post-treating step.

Hereinafter, brief description thereof will be given.

(1) A pre-treating step is a process of making the cloth (clothes, laundry) swollen (expanded) and (re)fresh such that scent can be well deposited onto the laundry. Supplying scent into a drum of a dryer in this specification is to, but not limited to, spray scent after drying the laundry, which has passed through washing and dehydrating. The scent supply process according to this specification may also be carried out by a user prior to wearing clothes kept in a closet for a long term of time. Namely, the clothes, which has been kept in the closet for a long term of time, may be wrinkled while being kept or permeate odor of the inside of the closet. To remove such wrinkles or odor, the scent supply process can be carried out. Here, upon performing the pre-treating step prior to supplying scent, the clothes may be made swollen to facilitate depositing of scent at the scent treating step.

At the pre-treating step, hot air heated by a heater may be supplied into the drum. Upon supplying such hot air, tissues of the laundry may be made softer and fresher. When such hot air is supplied, a cooling course for lowering a temperature within the drum should be carried out prior to initiating the scent treating step. This is because scent may be immediately evaporated without deposited onto the laundry when scent is sprayed onto the laundry in a high temperature state of the inside of the drum or the laundry, which may cause the intensity of the scent deposited onto the cloth to be lowered.

(2) A scent treating step is a process of pumping a scent solution stored in the aforesaid scent supply module and spraying the scent solution into the drum via a nozzle so as to permeate into the cloth. The scent supply module has exemplarily illustrated that a scent solution stored in a storage tub or chamber was pressurized by preset pressure using a pump to be sprayed into a drum via a nozzle. However, according to other exemplary embodiments, a supply passage for supplying scent may be open without pumping the scent solution by use of the pump so as to supply scent into the drum, or an evaporation unit for facilitating evaporation of scent from the scent solution may be employed to evaporate the scent solution to supply into the drum. Here, the evaporation unit may be installed at various positions, such as a front supporter, a rear supporter or inside a duct, into which scent is introduced.

(3) A post-treating step is carried out to make scent, which was sprayed into the drum, uniformly distributed onto the laundry and evenly dry the laundry. The post-treating step may include a cooling step, a drying step and a re-cooling step. The cooling step is to make scent sprayed into the drum easily transferred between the laundries. The drying step is to dry the scent, which was sprayed into the drum at the scent treating step. The re-cooling step is to lower the internal temperature of the drum to help a user to take the laundry out of the drum. Here, during a refreshing stroke, cooling may not be carried out upon an initial scent spraying, which will be described as follows.

Hereinafter, description will be given in detail of (1) pre-treating step, (2) scent treating step and (3) post-treating step.

(1) Pre-Treating Step

As the basic method, the pre-treating step is to first tumble the drum (rotating a drum by a driving unit at a constant speed). The tumbling may be carried out in a unidirectional or bidirectional manner. The laundry accommodated within the drum may experience ascending and descending processes in response to the tumbling while rotating together with the drum. These processes make the laundry swollen (expanded) and foreign materials stuck on the laundry thrown off such that the laundry can be in a fresh state.

A time taken for carrying out the tumbling at the pre-treating step may preferably be longer than a time taken for the scent treating step so as to sufficiently exhibit the effect of the pre-treating step. From the experimental results, a tumbling time of about 4 to 5 minutes may be appropriate.

During the tumbling process, air may be supplied into the drum. This operation is executed as operating (rotating) the blow fan located within the dryer. During the tumbling process, when air is circulated into the drum by the blow fan, abnormal odor remaining between the laundries may be removable and also such air may pass through the laundry to facilitate permeating of a scent material.

Here, the air supplied into the drum may be hot air heated by a heater. When such hot air is supplied, tissues of the laundry may become much softer and fresher. When the hot air is supplied, a process of lowering the internal temperature of the drum should be carried out prior to going into the scent treating step. This is because scent may be immediately evaporated without deposited onto the laundry when scent is sprayed onto the laundry in a high temperature state of the inside of the drum or the laundry, which may cause the intensity of the scent deposited onto the laundry to be lowered.

Thus, at the step of spraying scent, the internal temperature of the drum should be recognized. Here, the temperature may be based upon a temperature measured at a specific portion within the drum, a measured temperature of the laundry tumbled within the drum, or a measured temperature of air discharged out of the drum.

The intensity that a user feels scent deposited on the laundry (clothes) taken out of the drum is substantially subjective. However, it has been found from experiments that the level that the user feels intensity of scent becomes stronger (higher) when the internal temperature of the drum is low. The typical drying process of the dryer may perform a cooling course of supplying unheated air prior to taking the laundry out of the drum, thus to lower the temperature of the laundry to prevent a consumer from feeling hot when taking the laundry out. When examining the temperature at which the user pulls the laundry from the drum based on temperature at an outlet of the drum, it has been figured out the intensity of scent that a consumer feels at about 47° C. is much weaker than the intensity of scent that the consumer feels at about 30° C.

Figure 8:
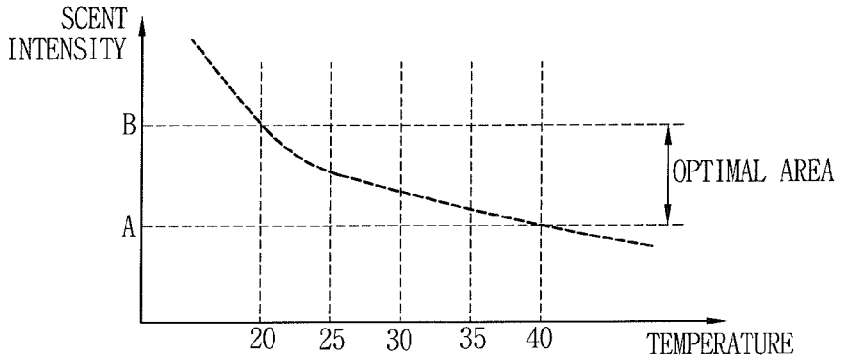
FIG. 8 is a graph showing an intensity change of scent according to temperature.

Referring to FIG. 8, the aforementioned facts are graphed. In the graph, a horizontal axis indicates the temperature of the drum at the moment when scent is sprayed into the drum, and a vertical axis indicates scent intensity that a consumer feels. This exemplary embodiment has measured the temperature based on an outlet temperature of the drum. Without limit to this, the temperature of the drum may be measured at another portion within the drum, and the temperature measured at the another portion may be compared with the corresponding scent intensity so as to be graphed. Here, when the temperature is measured at the another portion of the drum, the thusly-obtained graph may be different from the graph of FIG. 8 in view of detailed numerical values, but the general shape of the graph is the same.

Consequently, it has been revealed that spraying of scent into the drum is initiated from when the internal temperature of the drum is less than about 40° C., and the scent is excessively intensive at temperature below 20° C. to such an extent that several users feel uncomfortable. Hence, an optimal temperature for treating scent may be approximately between 40° C. and 20° C. Here, the user may desire to treat the laundry within a short time. Considering this, when the internal temperature of the drum is approximately between 35° C. and 25° C., it may be controlled to have an appropriate scent intensity within a proper time. Most preferably, when the temperature of the drum is controlled to be about 30° C. at the moment of spraying the scent, optimal results have been obtained in view of time and scent intensity. Here, the internal temperature of the drum was based upon the outlet temperature of the drum, but as aforementioned, the temperature of the drum may alternatively be replaced with a temperature measured at another portion within the drum. Here, upon using the temperature of the another portion of the drum, it may be different from the outlet temperature of the drum to some degree. According to an experiment, there is a difference of about 30° C. therebetween.

Scent intensity that the user feels scent deposited on the laundry may be designated in various levels according to the user's requirements. Selection buttons may be provided on a dryer control panel for allowing the user to select a desired intensity by means of a key input unit, and a controller of the dryer may control the internal temperature of the drum to differ so as to control the scent intensity corresponding to the button selected by the user. For example, after the user selects a course supporting a scent treating operation, when the user sets a desired scent intensity by means of a scent intensity adjusting unit capable of selecting the scent intensity and then presses a manipulation button of the dryer, the controller checks the scent intensity selected by the user (for example, strong, normal, weak), and controls the internal temperature of the drum according to the selected scent intensity. To this end, the controller fetches a temperature value of a temperature sensor (herein, a drum outlet temperature sensor). Afterwards, when 'strong' is selected by the user from the scent intensity adjusting unit, the controller controls a scent material to be sprayed or evaporated into the drum by running a scent spraying pump or switching valve for a preset time when the drum outlet temperature is 25° C., thereby treating the laundry with the scent. According to the same method, when 'normal' is selected by the user from the scent intensity adjusting unit, the controller controls the scent material to be sprayed or evaporated into the drum by running the scent spraying pump or switching valve for a preset time when the drum outlet temperature is 30° C., thereby treating the laundry with the scent. Also, when 'weak' is selected by the user from the scent intensity adjusting unit, the controller runs the scent spraying pump or switching valve for a preset time when the drum outlet temperature is 35° C., thereby treating the laundry within the drum with the scent.

Here, the scent intensity may be controlled by setting a cooling time (a time for supplying air which is not heated by a heater) corresponding to the scent intensity, other than the temperature value. Also, the scent intensity may be controlled by changing a spraying time, which will be described in detail in relation to the scent treating step.

(2) Scent Treating Step

The scent treating step may be characterized by tumbling a drum while spraying scent into the drum from a scent supply module for a predetermined time. An amount of scent sprayed into the drum may be determined based upon a mass flow of a scent solution sprayed, an operating time of a pump, an open time of a switching valve or the like. The amount of scent sprayed may be determined according to a user-selected scent intensity. That is, when the user selects a strong intensity from the scent intensity adjusting unit, the pump operating time or the like may be controlled to be longer such that more scent can be sprayed, thereby controlling the sprayed amount. Hereinafter, various exemplary embodiments for the scent treating step will be described.

1) First Exemplary Embodiment

The first exemplary embodiment illustrates a consecutive s praying and an intermittent spraying among various methods for spraying scent into the drum.

In this exemplary embodiment, the consecutive spraying corresponds to consecutively spraying scent from a scent supply module into a drum, and the intermittent spraying corresponds to intermittently spraying scent into the drum by repetitively switching on/off a pump or switching valve of the scent supply module. These consecutive spraying and the intermittent spraying may be selective according to an amount of the laundry (i.e., clothes (laundry) amount) put into the drum. The consecutive spraying may be carried out when the controller of the dryer detects the clothes amount put into the drum to determine it as a less amount of laundry, and the intermittent spraying may be carried out when the controller determines the detected clothes amount as a large amount of laundry.

More especially, the process of treating scent in this exemplary embodiment may be divided into a case of selecting by a user a scent treating operation and a case of selecting by a user a general drying operation including a scent spraying course. First, a process, which may be carried out when the user selects the scent treating operation, may include selecting a scent treating operation, detecting a laundry amount by a dryer controller, carrying out an intermittent spraying when the large amount of laundry is detected at the laundry amount detecting step and carrying out a consecutive spraying when the less amount of laundry is detected at the laundry amount detecting step. Here, at the intermittent spraying step, switch on/off operations may be repeated for a preset time according to the detected clothes amount so as to spray scent into the drum.

Figure 9:
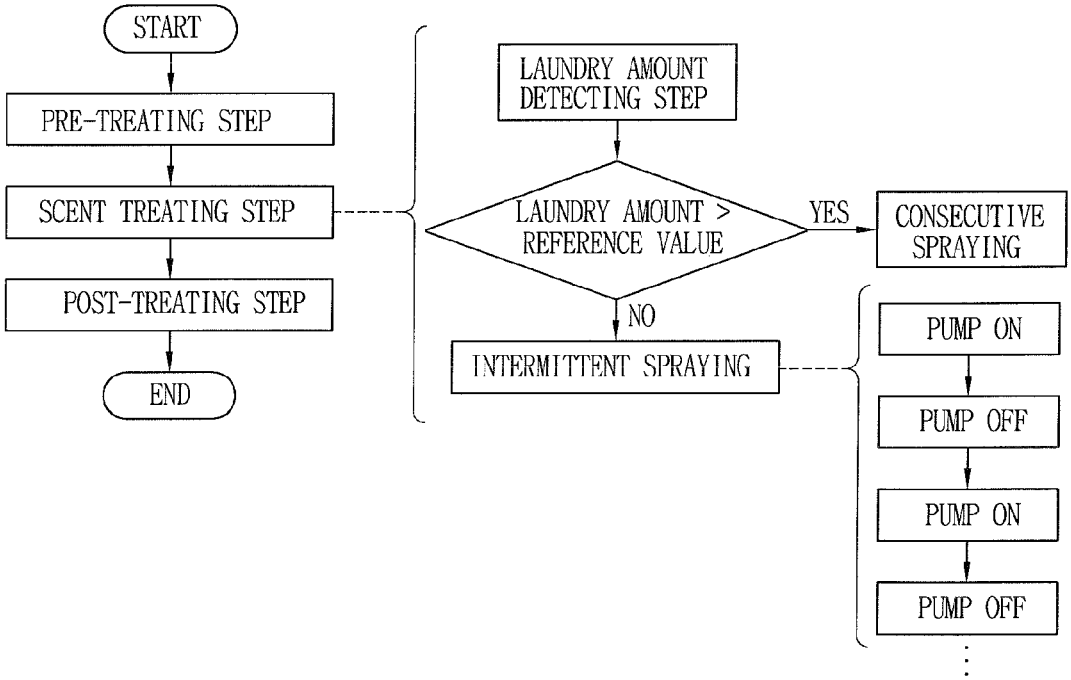
FIG. 9 is a flowchart showing a scent spraying method in accordance with one exemplary embodiment.

FIG. 9 shows steps of the general drying operation including the scent spraying step. The steps may include a pre-treating step, a scent treating step and a post-treating step. The scent treating step may be carried out to spray scent into the drum by re-detecting the laundry amount by the controller. Here, the intermittent spraying may be carried out when the large amount of laundry is detected by the controller at the scent spraying step, and the consecutive spraying may be carried out when the less amount of laundry is detected by the controller. At the intermittent spraying step, switch on/off operations may be repeated for a preset time according to the detected laundry amount so as to spray scent. Also, the time for spraying scent (consecutive spraying or intermittent spraying) may be set based upon a user-selected scent intensity or a laundry amount or both.

The reason of intermittently spraying scent for the large amount of laundry may be as follows. That is, for the less amount of laundry, scent sprayed may be uniformly easily deposited onto the laundry. However, for the large amount of laundry, the consecutive spraying may not result in uniform scent deposition. Hence, when there are the large amount of laundry, after spraying scent from the scan supply module into the drum for a preset time, the drum is tumbled to make the clothes tangled and untangled. Afterwards, the scent may be sprayed again so as to be effectively deposited onto the laundry. Theses processes may allow uniform deposition of scent onto the laundry, thereby improving scent uniformity. Several factors, which facilitate scent to be uniformly deposited onto the laundry will be described hereinafter. Satisfactory uniformity may be generally exhibited when the number of spraying scent (spraying times) is 3 to 4 times irrespective of the laundry amount.

According to an experiment, it may be preferable that the consecutive spraying is carried out when the laundry amount is 1 to 2 kg and the intermittent spraying is carried out when the laundry amount exceeds 3 kg. For the intermittent spraying, an intermittent interval, namely, a time for pump off may preferably be a time taken to rotate the laundry within the drum in response to the rotation of the drum (i.e., a time taken while the laundry are lifted and dropped in response to the rotation of the drum and then tangled or untangled), and this time may preferably be about 5 seconds. A time for which the pump of the scent supply module is run during the intermittent spraying may preferably be set such that the last pump-on time is the same as or longer than the previous pump-on time. That is, if the pump-on time at the last step of the on/off stroke is longer than that at the intermediate step, the amount of scent components last sprayed onto the laundry may be increased the most such that the scent can remain long on the laundry. For example, for 3 kg of laundry, during the intermittent spraying process when a user selects the scent intensity of 'normal,' the pump-on/off time of the scent supply module is checked in the order of 15-second ON, 5-second OFF, 15-second ON, 5-second ON, 5-second OFF and 20-second ON.

2) Second Exemplary Embodiment

The second exemplary embodiment illustrates a course carried out when desiring to treat the clothes being dressed or kept with scent within a short time, other than a drying course executed after washing and dehydrating. This indicates a touchup course. Here, detection of the clothes amount may not be necessary, and scent spraying may be carried out through the consecutive spraying process. Here, the detection of the clothes amount is omitted because the original purpose of the touchup course is to treat a small amount of loads with scent.

Figure 10:
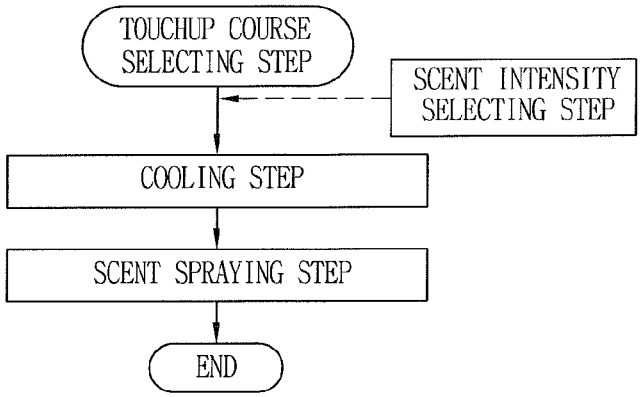
FIGS. 10 to 12 are flowcharts each showing a scent spraying method in accordance with different exemplary embodiments.
Figure 11:
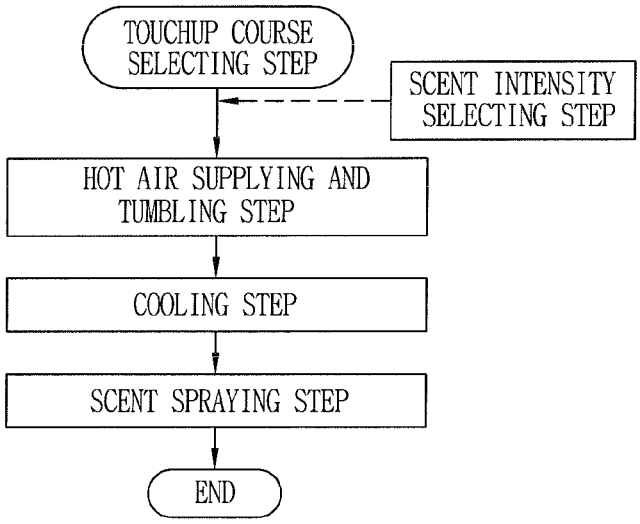
Figure 12:
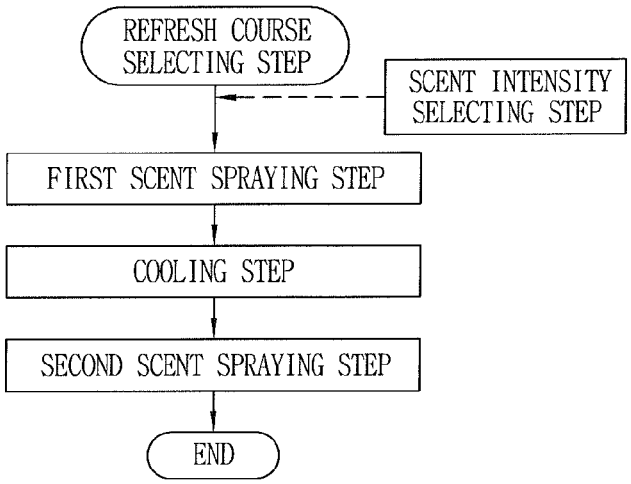

FIGS. 11 and 12 show steps of the touchup course in accordance with this exemplary embodiment. The touchup course may include a touchup course selecting step, a cooling step and a scent spraying step (see FIG. 10). Here, the touchup course may further include, prior to the cooling step, a hot air supplying and tumbling step of supplying hot air into the drum and executing tumbling (see FIG. 11). Here, the cooling step may be carried out right before the scent spraying step to help deposition of scent onto the laundry. The scent spraying step may be carried out to consecutively spray scent.

Also, in accordance with another exemplary embodiment of the touchup course, it may include a step that the user selects a scent intensity. Here, this another exemplary embodiment of the touchup course may include a touchup course selecting step, a scent intensity selecting step, a cooling step and a scent spraying step. Here, an amount of scent sprayed may be controlled according to the scent intensity selected by the user. The amount of scent sprayed may alternatively be controlled according to an operating time of the pump or valve of the scent supply module.

3) Third Exemplary Embodiment

The third exemplary embodiment illustrates a course of removing wrinkles or odor from the clothes by spraying scent onto the clothes within the drum. This corresponds to a scent refresh course. The third exemplary embodiment is different from the second exemplary embodiment in the aspect of removing odor and wrinkles from the clothes being dressed or kept for a long term of time and simultaneously supplying scent onto the clothes.

FIG. 12 shows a refresh operation in accordance with one exemplary embodiment, which may include a refresh course selecting step, a first scent spraying step, a cooling step and a second scent spraying step. Here, during the scent spraying step, the consecutive spraying of consecutively spraying scent may be carried out. A time taken for spraying scent during the first scent spraying step may be set to be longer than a time taken for spraying scent during the second scent spraying step. Accordingly, more scent can be sprayed during the first scent spraying step to achieve wrinkle removal and odor removal from the clothes. A drying step of drying the clothes by supplying hot air may further be carried out between the first scent spraying step and the second scent spraying step.

In accordance with another exemplary embodiment of the refresh operation, a user may select a scent intensity. This refresh operation may include a refresh course selecting step, a first scent spraying step, a cooling step and a second scent spraying step. When the user selects a scent intensity, an amount of scent sprayed may be controlled according to the selected scent intensity. The amount of scent sprayed may alternatively be controlled according to an operating time of the pump or valve of the scent supply module.

In course of the scent spraying at the scent treating step, the drum may be rotated and simultaneously the blow fan of the dryer may be continuously driven to supply air into the drum, or the drum may be rotated but the blow fan of the dryer may be turned off not to supply air into the drum.

As aforesaid, there may be a one-motor system having a single motor simultaneously functioning as a drum driving motor for rotating the drum and a fan motor for rotating the blow fan are the same, and also a two-motor system having two separate motors respectively functioning as the drum driving motor for rotating the drum and the fan motor for rotating the blow fan. The one-motor system may be configured such that when one of the blow fan and the drum is rotated, the other one is also rotated because the single motor drives both the drum and the blow fan, while the two-motor system may be configured such that the drum and the blow fan can be rotated independent of each other.

Hence, in the two-motor system, during scent spraying, the drum may be rotated but the blow fan may not be run, which allows scent to be sprayed in a state of no air flow occurred within the drum, resulting in more effective deposition of scent onto the laundry or clothes.

(3) Post-Treating Step

The post-treating step is a step of carrying out a cooling process for a preset time to supply air into the drum by rotating the blow fan with a heater off after completion of the scent spraying step of spraying scent. This post-treating step may be carried out to allow scent components to be firmly deposited onto the clothes or laundry, without being evaporated from the laundry, through the cooling step executed right after the scent spraying. Also, the drum may be continuously tumbled such that scent can be evenly deposited onto the laundry by virtue of the tumbling.

The post-treating step may further include a drying process for removing moisture, which might be left in the laundry or clothes by the scent sprayed during the scent spraying step, so as to make a user feel comfortable. The drying process may be carried out to supply hot air into the drum by running the heater of the dryer. The post-treating step may further include a cooling process carried out after the drying process to prevent the user from feeling hot when taking the laundry out of the drum. Here, the temperature for the cooling process may be set to be higher than the temperature of the cooling process for spraying scent during the scent spraying step. Thus, the drying may preferably be completed at temperature of about 47° C. If the post-treating step right after the scent spraying is excessively long, scent may be evaporated. Therefore, the post-treating step should be shorter than the pre-treating step executed prior to the scent treating step.

The foregoing description has been given of the method for supplying scent using the scent supply module. When spraying scent into the drum after putting the laundry into the drum, it may be important to evenly deposit such scent onto the laundry, which is referred to as uniformity. Hereinafter, factors affecting the uniformity will be briefly described with reference to the accompanying drawings.

Figure 13:
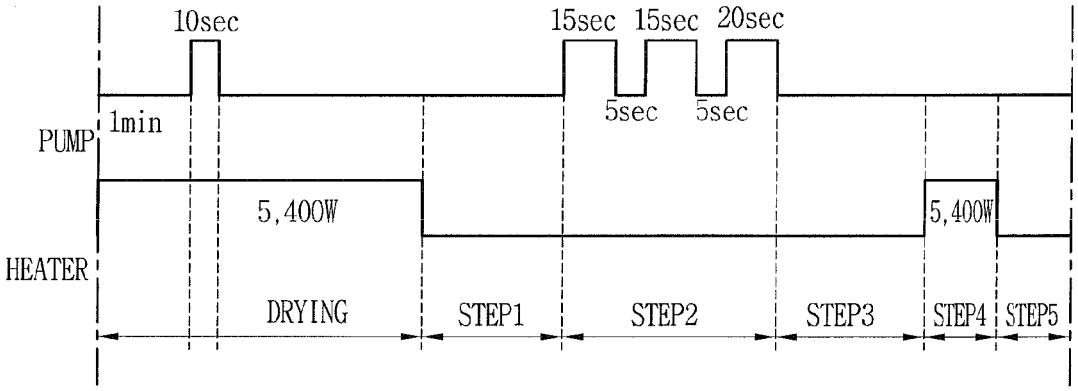
FIG. 13 is a flowchart showing an overall process of carrying out a drying stroke in accordance with one exemplary embodiment.

FIG. 13 generally shows the procedure of performing a drying stroke, which shows a period of time when the pump of a scent spraying module is run and a period of time when a heater located within a dryer is run according to a lapse of time. Spraying scent by driving the pump of the scent supply module 1 minute after initiating the drying stroke in the graph may be a process of removing remnant scent, which may be left during the scent supply process carried out at the previous step.

Briefly explaining the overall procedure, Step 1 is a term having a short interval prior to scent spraying after completion of drying. Step 2 is a process of spraying scent into the drum by running the pump of the scent spraying module. Step 3 is a cooling term for cooling the drum for a preset time. Step 4 is a process of partially drying sprayed scent by running the heater again, and Step 5 is a cooling process of cooling the laundry such that a consumer can finally take the laundry out for use. Each of those steps has been described above, so detailed description will be omitted. Hereinafter, description will be given of uniformity, which indicates the level of scent being evenly sprayed onto the laundry during each step.

Figure 14:
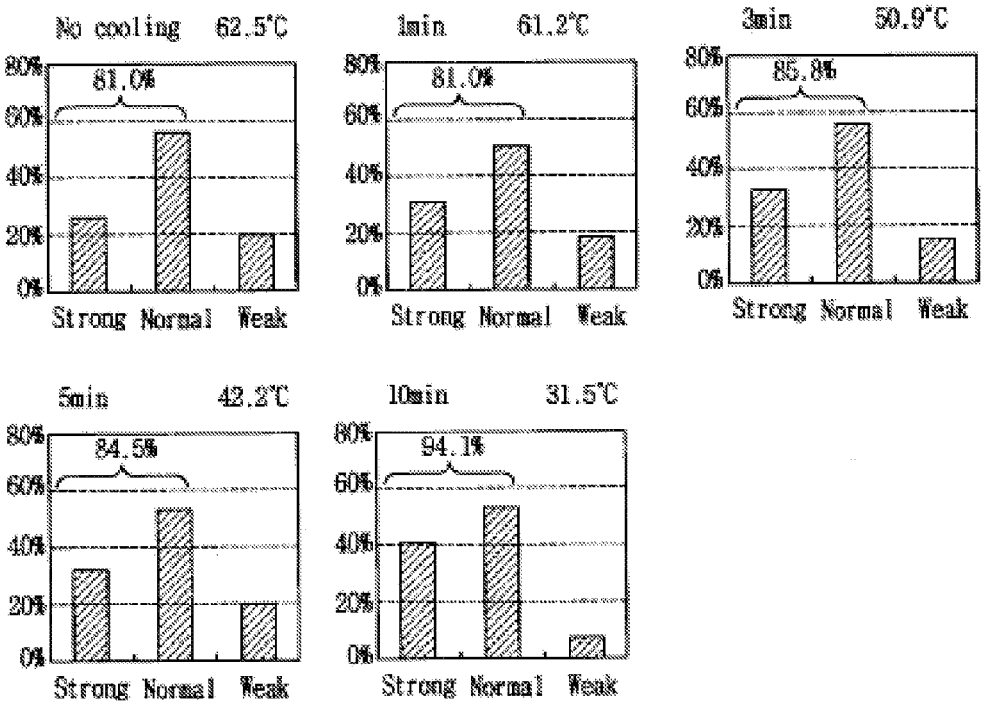
FIG. 14 shows graphs each exhibiting an influence of a cooling time on uniformity prior to scent spraying, after a drying process.

FIG. 14 shows graphs showing results of experiments each for checking an influence of a cooling time at Step 1 of FIG. 13 on uniformity. The graphs show the uniformity of scent when scent intensity is strong, normal and weak, and the vertical axis of the graph indicates the uniformity. The experiments have been performed by setting a cooling time of Step 1 to 0 minute (no cooling), 1 minute, 3 minutes, 5 minutes and 10 minutes, respectively. The temperature shown in the right of the execution time indicates an internal temperature of the drum measured after such cooling time elapses. As shown in the graph, satisfactory uniformity is exhibited when the internal temperature of the drum is 31.5° C. after executing the cooling at Step 1. Therefore, for better uniformity, it may be required to set the cooling time at Step 1 such that the temperature of the drum can be lowered to about 30° C.

Figure 15:
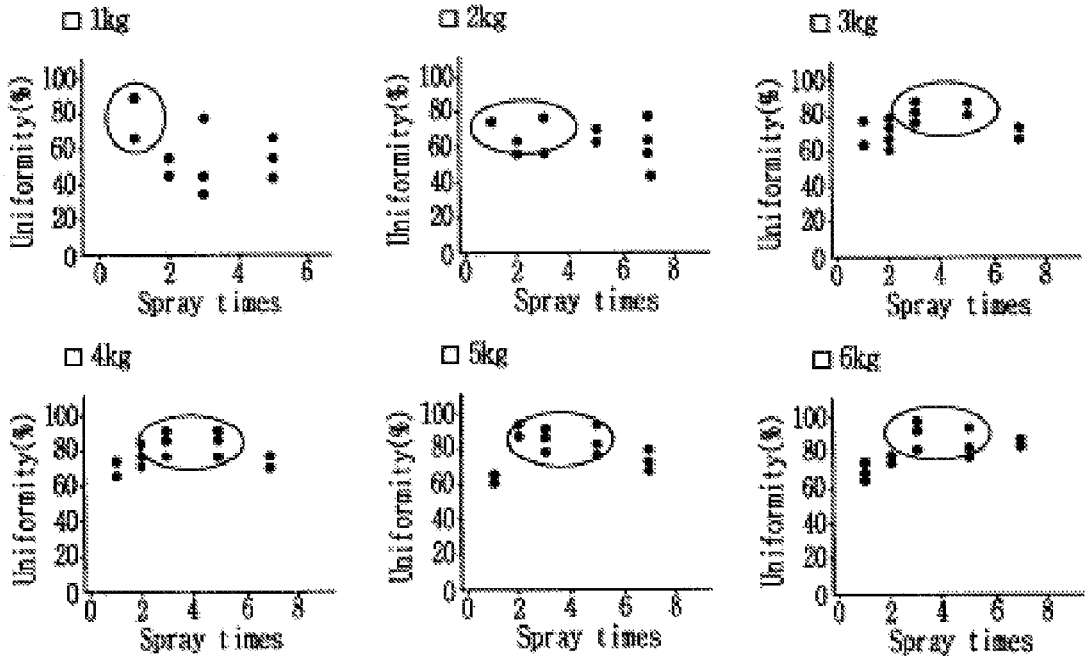
FIG. 15 shows graphs each exhibiting a relation between the number of spraying (spraying times) and uniformity upon intermittently carrying out a scent spraying process.

FIG. 15 shows graphs, each of which shows a relation between the number of spraying (spraying times) and uniformity after intermittently spraying scent at Step 2 during the process of spraying scent from a scent spraying module. A horizontal axis of FIG. 15 indicates the spraying times of spraying scent into the drum, and the vertical axis indicates the uniformity. The experiments have been executed to check the relation between the scent spraying times and uniformity by changing an amount of clothes or laundry introduced in the drum from 1 kg to 6 kg. As can be seen in the graphs shown in FIG. 15, for 1-2 kg of clothes, satisfactory uniformity is exhibited even when scent spraying is performed one time, so, in this case, the consecutive spraying may be appropriate. However, when the amount of clothes is increased more than that, satisfactory uniformity is exhibited when repetitively spraying scent 3 to 4 times. Therefore, when the amount of clothes exceeds 2 kg, it may be preferable to carry out the intermittent spraying.

Figure 16:
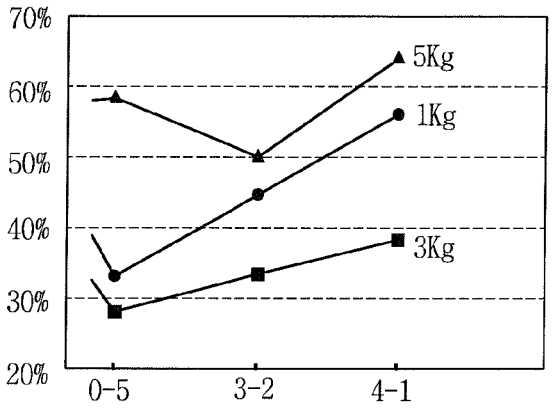
FIG. 16 is a graph showing a relation between a cooling time and uniformity after carrying out a scent spraying process.

FIG. 16 shows uniformities measured with changing the cooling time at Step 3 to Step 5. In the graph, after the total cooling time (namely, the sum of cooling time of Step 3 and Step 5) is set to 5 minutes, the total cooling time is partially distributed to Step 3 and Step 5, thereafter measuring uniformities. Two numerical values indicated in the horizontal axis of the graph indicate the cooling times of Step 3 and Step 5, respectively, and a unit of time is minute. That is, the numerical values 3-2 indicate performing cooling for 3 minutes at Step 3 and performing cooling for 2 minutes at Step 5. As can be seen in the graph, more satisfactory uniformity is exhibited when the cooing time of Step 3 is longer than the cooling time of Step 5, which means that after scent is sprayed, such scent can be evenly spread onto the laundry during cooling and tumbling at Step 3. It can be found from those experiments that each cooling time of Step 3 and Step 5 may preferably be set to 4 minutes and 1 minute and a drying time of Step 4 may preferably be set to 0.5 minutes. That is, it is the most preferable to perform cooling for 4 minutes, drying for 0.5 minutes and cooling for 1 minute after intermittently spraying scent at Step 3.

The invention claimed is:

1. A method for operating a laundry dryer comprising a drum rotatably mounted inside a main body, a heater for heating air flowing into the drum, and a scent supply module for spraying scent into the drum, the method comprising:

a drying step of drying the laundry by supplying hot air heated by the heater;

a pre-treating step of tumbling the drum while supplying air with the heater off; and a scent treating step of spraying scent onto the laundry passed through the pre-treating step, wherein the drying step comprises a remnant scent removing step of removing scent remaining in the scent supply module by temporarily spraying scent into the drum from the scent supply module.

2. The method of claim 1, wherein a time taken for the pre-treating step is longer than a time taken for the scent treating step, and a temperature inside the drum is cooled down below 30° C. at the pre-treating step.

3. The method of claim 1, wherein the drum is continuously tumbled during the scent treating step.

4. The method of claim 1, wherein the scent is sprayed at the scent treating step when the temperature of the drum is in the range of 20° C. to 40° C.

5. The method of claim 3, wherein air is not supplied into the drum during the scent treating step.

6. The method of claim 1, wherein at the scent treating step, the intermittent spraying is carried out when the laundry amount inserted within the drum is larger than a reference value, and the consecutive spraying is carried out when the laundry amount inserted within the drum is smaller than the reference value.

7. The method of claim 1, further comprising a post-treating step of supplying air with the heater off after completion of the scent treating step.

8. The method of claim 7, wherein the drum is continuously tumbled during the pre-treating step, the scent treating step and the post-treating step.

9. The method of claim 8, wherein air is not supplied into the drum during the scent treating step.

10. The method of claim 7, wherein the post-treating step comprises:

a first post-treating step of supplying air into the drum with the heater off;

a post-treating drying step of supplying air into the drum with the heater on; and a second post-treating step of supplying air into the drum with the heater off, wherein the post-treating drying step is to dry moisture generated due to the scent sprayed onto the laundry during the scent treating step.

11. The method of claim 10, wherein a time taken for the first post-treating step is longer than a time taken for the second post-treating step.

12. The method of claim 1, further comprising a scent intensity selecting step of selecting intensity of scent sprayed into the drum prior to the scent treating step.

13. The method of claim 12, wherein as the scent intensity selected at the scent intensity selecting step is stronger, the scent is sprayed at a time point when the temperature inside the drum is lower.

14. The method of claim 12, wherein as the scent intensity selected at the scent intensity selecting step is stronger, a time taken to carry out the pre-treating step becomes longer.

15. The method of claim 12, wherein as the scent intensity selected at the scent intensity selecting step is stronger, a time for which the scent is sprayed during the scent treating step becomes longer.

16. A scent refreshing method for a laundry dryer comprising a drum rotatably mounted inside a main body, a heater for heating air flowing into the drum, and a scent supply module for spraying scent into the drum, the method comprising:

a selecting step of selecting a scent refresh course;

a hot air supplying step of supplying hot air heated by the heater into the drum;

a first scent spraying step of spraying scent into the drum;

a pre-treating step of supplying air into the drum with the heater off to cool the drum;

a second scent spraying step of spraying scent into the drum; and a post-treating step of supplying air for cooling with the heater off, wherein a time taken for the first scent spraying step is set to be longer than a time taken for the second scent spraying step so as to remove wrinkles and odor from the laundry.

17. The method of claim 16, wherein the first scent spraying step is carried out while the hot air supplying step is ongoing.

18. The method of claim 16, wherein at the first scent spraying step and the second scent spraying step, air is not supplied into the drum.

* * * * *